United States Patent [19]

Savar et al.

[11] 4,179,139

[45] Dec. 18, 1979

[54] COMBINATION CHECK AND CREDIT CARD SALES SLIP

[76] Inventors: Eugene J. Savar; Cindy Savar, both of 11B Ivy Ct., Mapleshade, N.J. 08052

[21] Appl. No.: 958,098

[22] Filed: Nov. 6, 1978

[51] Int. Cl.[2] ..... B41L 1/24

[52] U.S. Cl. ..... 282/23 R; 283/58; 283/60 R

[58] Field of Search ..... 283/57, 58, 60 R; 282/22 R, 23 R

[56] References Cited

U.S. PATENT DOCUMENTS

| | | | |
|---|---|---|---|
| 1,939,793 | 12/1933 | Rudolph | 282/22 R |
| 2,678,223 | 5/1954 | Shepherd | 282/23 R |
| 3,048,426 | 8/1962 | Rodriguez et al. | 282/23 R |
| 3,058,758 | 10/1962 | Govatsos | 282/23 R |
| 3,147,028 | 9/1964 | Scully | 282/23 R |
| 3,233,918 | 2/1966 | Tathwell | 282/9 |
| 3,254,906 | 6/1966 | Moss | 282/23 R |
| 3,257,129 | 6/1966 | Malone | 282/23 R |
| 3,290,061 | 12/1966 | Glassman | 282/23 R |
| 4,045,053 | 8/1977 | Carriere | 282/22 R |

*Primary Examiner*—John McQuade

*Attorney, Agent, or Firm*—Weiser, Stapler & Spivak

[57] ABSTRACT

A package of preprinted forms includes one form printed on one side as a conventional bank check, and on the reverse side as a conventional credit card sales slip. Overlying the sales slip printed side of this first form is a second form, printed as a corresponding credit card customer receipt form. Carbon is provided between the two forms to transfer writing from the receipt to the sales slip on the reverse side of the check. A protector between the forms prevents writing on the check side from being unintentionally reproduced on its reverse, sales slip side.

17 Claims, 3 Drawing Figures

COMBINATION CHECK AND CREDIT CARD SALES SLIP

Figure 1:
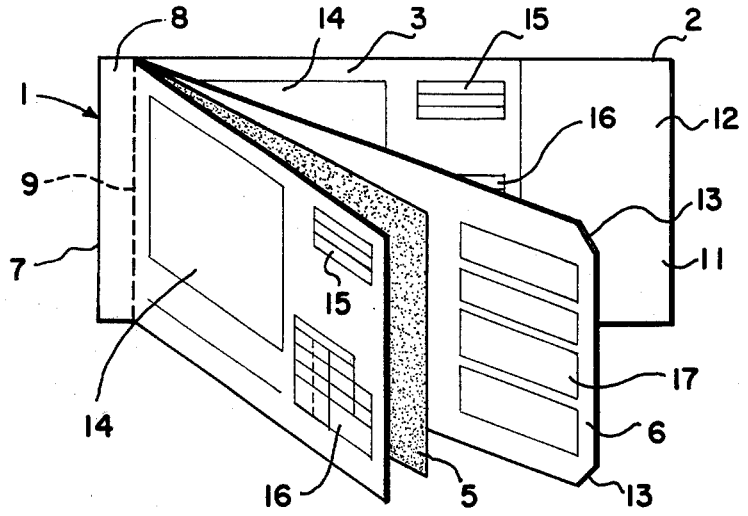

This invention relates to a forms package for use primarily in connection with the financial transactions which accompany retail purchases.

There are currently in vogue three basic types of financial transactions accompanying retail purchases. One of these involves simply paying cash for the purchase. The second involves writing a check on the retail customer's personal checking account. The third involves utilizing a credit card issued to the customer by a financial institution, or other recognized source.

The basic advantages and disadvantages of these different types of financial transactions are too well known to warrant detailed discussion here. Suffice it to briefly restate that no one of these is completely satisfactory in all circumstances.

Perhaps the use of cash, except in relatively small amounts, is the least satisfactory of the three. It presents a loss and theft problem to both customer and merchant; it creates a problem of bulk if required in large amounts; it ties up funds that could be used more productively while waiting to be expended; and so forth.

Checks are much more flexible, safe, and generally attractive from the customer's point of view. On the other hand, they create a serious problem for the merchant, who must then rely entirely on the credit of the customer whose personal check is taken in payment for the purchase. The risk which this creates for the merchant is considered so great that elaborate precautions in terms of customer identification, bank balance verification, and so forth, are typically taken when dealing with checks. Indeed, in many cases, checks are simply refused as payment.

Finally, credit cards, although comparatively safe and convenient from both the customer and merchant standpoint, have two major drawbacks. One is that the amounts which can be charged against credit cards are often subject to an upper limit. This restricts their utility. The other is that the organizations which issue these cards make a charge for the card transaction. This in effect correspondingly increases the cost of the merchandise being purchased.

Accordingly, it is a principal object of the present invention to provide a means for accomplishing the financial transactions incident to a retail purchase which overcomes one or more of the drawbacks discussed above.

It is another object of the invention to provide such a means which utilizes non-cash transactions, and which also eliminates one or more of the drawbacks of check and credit card transactions.

It is still another object to provide such a means which preferentially utilizes the advantageous features of both checks and credit cards.

It is still another object to provide a forms package for use in practicing the technique referenced above.

These and other objects are achieved in accordance with the present invention as follows.

There is provided a manifolded forms "package" which consists of a first form having printed on the exposed side a conventional bank check blank. On the reverse side of that first form there is printed a credit card sales slip blank. A second form overlying the reverse side of the first form has printed on it a credit card customer receipt blank matching the credit card sales slip blank on the first form. Provisions are also made to cause writing on the credit card receipt blank to be reproduced on the underlying sales slip blank, while preventing writing on the check blank from being so reproduced.

When this package is used in connection with a purchase, the customer fills in, or "writes" the check in conventional manner for the amount of the purchase. In addition, the customer tenders a credit card acceptable to the merchant. This credit card, together with suitable manual entries, including the customer's signature, is used to fill in the credit card receipt and through carbon transfer, simultaneously also the sales slip on the reverse side of the check.

The two forms are then separated, the merchant keeping the one which is filled in front and back (the check and sales slip), the customer keeping the other (the receipt).

The merchant deposits his form for collection as a check in conventional manner. If this check is honored, that is the end of the transaction. If the check is dishonored, then the same form is resubmitted by the merchant to the credit card organization, and the financial transaction is completed in that manner.

Figure 2:
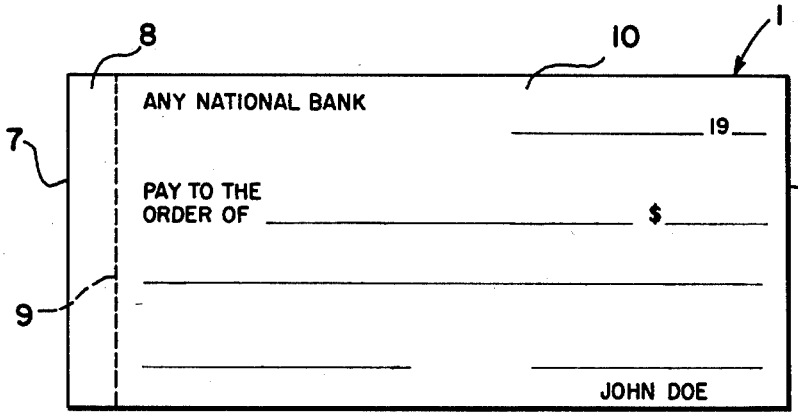
Figure 3:
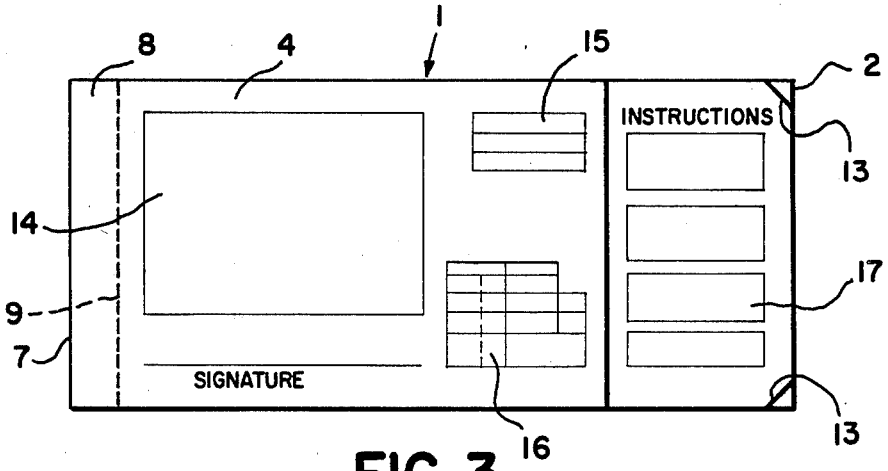

For further details, reference is made to the discussion which follows, taken in light of the accompanying drawings in which like reference numerals refer to similar structure, and in which, FIG. 1 is a perspective view of the financial transaction package embodying the invention, spread open to show its multiple constituent parts;

FIG. 2 is a bottom plan view of the package in which there is visible the side printed with a conventional check blank; and FIG. 3 is a top plan view of the package in which there is visible the credit card receipt form which constitutes part of the package; and also, the protector which prevents writing on the check side from being unintentionally reproduced on the reverse, sales slip side.

As illustrated in FIG. 1, the package 1 consists of several sheets. Of these, sheet 2 has printed on its one side 10 (visible in FIG. 2) the conventional blanks of a bank check. Its reverse side 3 (partially visible in FIG. 1) is printed with the blanks of a conventional credit card sales slip. The same blanks as on side 3 of sheet 2 are also printed on sheet 4.

A sheet of carbon paper 5 is provided between sheets 2 and 4, for transferring entries made upon sheet 4 to sales slip 3. Finally, a separator sheet 6 is provided between carbon sheet 5 and sales slip 3 to temporarily prevent carbon sheet 5 from marking sales slip 3. These sheets 2, 4, 5 and 6 are attached along a common edge 7.

Both the receipt sheet 4 and the check bearing sheet 2 are preferably made of paper stock, as is conventional for checks and credit card receipts. Separator sheet 6 is peferably formed of a light stock of cardboard.

Each of the sheets 2, 4, 5 and 6 are provided with an extension 8, along which they are joined together, by staples or glue, to form a unitary package. Each sheet is preferably also provided with perforations 9, to permit easy and neat detachment from the package.

FIG. 2 shows the exposed side 10 of sheet 2, which is preprinted as a conventional check to be written by the customer upon a checking account maintained by that customer at a particular bank. This includes bank name, transit number, machine readable codes, blanks for date, amount, payee and signature, and so forth.

The reverse side 11 of the check 10 is also provided with a blank area 12 (visible in FIG. 1), which is suitable for containing the endorsements of the check, in accordance with conventional banking procedures.

The reverse side 11 of the check 10 is also printed with the credit card sales slip 3. The sales slip 3 is provided with the conventional blanks for credit card use. These include space for reproducing the credit card data, price, signature, etc. Corresponding blanks are provided on sheet 4 of package 1.

In use, the customer fills in the blanks of the check 10 in the conventional manner. During this process, the separator sheet 6 is in place. Therefore, even if writing on check 10 is done with sufficient pressure to cause transfer of carbon from sheet 5, this will not reach the reverse side 11 containing sales slip 3, but will be intercepted by separator sheet 6.

After check 10 is completed, separator sheet 6 is detached and the package 1 turned over, so that credit card receipt sheet 4 becomes uppermost.

The undercut corners 13 of separator 6 facilitate its removal by making it easier to distinguish it by touch from the adjacent check-bearing sheet 2.

The credit card portion of the transaction is then carried out. For example, using the customer's credit card, the name, address and account number of the customer may be recorded in area 14 (see FIGS. 1 and 3). Areas 15 and 16 may be used to record other information, such as the date of the transaction, transaction code numbers, nature of the goods purchased, price, tax, and so forth. The customer also signs the completed sheet 4 in conventional manner. It is also possible at this time, if desired, to verify the credit of the purchaser through the credit lending institution as is customary in such transactions.

Since separator sheet 6 is absent during all this the entries on sheet 4 are immediately reproduced on sales slip 3, appearing on the reverse side 11 of sheet 2.

After credit card receipt sheet 4 is completed, it is detached from the package 1 and delviered to the customer as a receipt of the transaction. Sheet 5 is detached from the package 1 and discarded.

This now leaves the merchant in possession of a single document 2, having on its one side 10 a conventional bank check, and on its reverse side 11 a conventional credit card sales slip 3. In accordance with the invention, this document is deposited by the merchant as a check for collection in conventional manner.

Should the check 10 fail to clear for any reason, it is in due course returned to the merchant who deposited it. In such a case, the merchant would not seek recourse against the customer, but would submit the same document (sales slip 3) in the conventional manner for payment by the organization whose credit card was used to complete the reverse side 11 of that document. At this point, the merchant would recieve payment irrespective of the state of the customer's bank account.

The very substantial desirable features of the present invention will now be apparent. Those include the following.

The retail customer is enabled to use a personal checking account in establishments which do accept credit cards, but previously would not have accepted a personal check. This greatly extends the usefulness of personal checks, including reliance upon them even when traveling or moving.

Acceptance of the customer's personal check, even where this would otherwise have been possible, may be simplified and expedited because it is no longer necessary to use involved personal identification procedures.

By drawing on a personal checking account first, the availability of credit through the credit card organization is preserved and the availability of purchasing power enhanced.

The customer is not limited to cash on hand, but has the means to pay the equivalent of cash without carrying large amounts.

The overall costs to both merchant and customer will tend to be reduced. This is due to the fact that merchants will enjoy considerable savings from the reduction and dollar impact of returned, uncollected checks, as well as from a reduction in the fees associated with accepting credit cards.

Neither the customer nor the merchant needs to acquire any new techniques or habits of handling financial transactions. The individual forms used are all familiar from prior use, and the deposits and other handling procedures are also traditional.

Even the banking industry may perceive highly desirable features in this invention.

The package 1 would normally be issued by the particular bank which is identified on check 10 printed on sheet 2 of the package. This would therefore constitute a new opportunity to serve the bank's depositors. The credit card forms which are part of package 1, on the other hand, could be made of universally usable format, so that the customer would not be restricted in using the package only with a particular credit card.

By enhancing use of checking accounts as the initial method of payment, it can be expected that demand balances on deposit would increase, with resulting benefits to the depository bank.

Although the invention has been described particularly with reference to retail transactions, it will be understood that it is not so limited but may be used for other transactions within the purview of the checking and credit card systems.

It is also to be understood that variations are possible in the embodiment of the invention described above.

For example, the printing on check 10, sales slip 3, or receipt 4 need not be the same as shown in the drawings, but may be any printing appropriate to the procedures for checks and credit cards.

The package 1 is shown attached at its left edge. However, it is possible to attach the package at the top, bottom, or right edge as well.

Carbon sheet 5 is also not always necessary. In its place there may be used for receipt sheet 4 a paper which has a pressure sensitive coating on the reverse side such that data written upon the face of sheet 4 is reproduced upon sales slip 3. Such treated paper is described in U.S. Pat. No. 2,548,366.

It is even possible to have a package 1 having no means of any kind for transferring data from receipt sheet 4 to sales slip 2. In such case, carbon papers of conventional type could be used in filling out the receipt sheet 4 which are manually inserted between the receipt sheet 4 and sales slip 3 after the check 10 has been completed. In such case the separator 6 would also not be necessary.

It is also possible to utilize the separator 6 as an instruction sheet, by placing thereon instructions concerning use of package 1, for example, in the areas designated by reference numeral 17 in FIG. 3.

Although a package 1 having only one sheet 2 and one receipt sheet 4 is preferred, it is also possible to have a package 1 having more than one receipt sheet 4, if desired.

We claim:

1. A financial transaction package comprising a plurality of superposed sheets, a first sheet being printed as a check blank on one side, and being printed with a credit card sales slip blank on the reverse side, and a second sheet being positoned adjacent said credit card sales slip blank and printed with a credit card receipt blank.

2. The package of claim 1 further comprising means for transferring data applied to the credit card receipt blank simultaneously to the sales slip blank.

3. The package of claim 2 which the transferring means is positioned between the first and second sheets.

4. The package of claim 3 wherein the transferring means is carbon paper.

5. The package of claim 3 wherein the transferring means is a pressure sensitive coating on the back of the receipt blank.

6. The package of claim 2 further comprising means for inhibiting the transfer of said data.

7. The package of claim 6 wherein the inhibiting means is a separator sheet, positioned between the transferring means and the first sheet.

8. The package of claim 7 wherein the separator sheet is removable from the package.

9. The package of claim 8 wherein the first and second sheets are also removable from the package.

10. The package of claim 7 wherein the first and second sheets, the transferring means, and the separator sheet are attached to each other along a common edge.

11. The package of claim 10 wherein the attachment is with perforations to facilitate removal.

12. The package of claim 7 wherein the separator sheet has at least one corner which is undercut, thereby facilitating separation between the separator sheet and the remainder of the package.

13. The package of claim 7 wherein the first sheet is longer that the second.

14. The package of claim 14 wherein the portion of the reverse side of the first sheet which extends beyond the second sheet is free of printing.

15. The package of claim 7 wherein the separator sheet is substantially coextensive with the first sheet.

16. The package of claim 1 wherein the package has one first sheet and one second sheet.

17. The package of claim 2 wherein the areas of the credit card receipt blank and the sales slip blank in which the data is applied are in alignment with each other.

* * * * *